US006559607B1

(12) United States Patent
Ervin et al.

(10) Patent No.: US 6,559,607 B1
(45) Date of Patent: May 6, 2003

(54) MICROWAVE-POWERED ULTRAVIOLET ROTATING LAMP, AND PROCESS OF USE THEREOF

(75) Inventors: Robert Ervin, Gaithersburg, MD (US); Pedro A. Lezcano, Gaithersburg, MD (US); Miodrac Cekjc, Bethesda, MD (US)

(73) Assignee: Fusion UV Systems, Inc., Gaithersburg, MD (US)

( * ) Notice: Subject to any disclaimer, the term of this patent is extended or adjusted under 35 U.S.C. 154(b) by 0 days.

(21) Appl. No.: 10/043,171

(22) Filed: Jan. 14, 2002

(51) Int. Cl.[7] ..... H05B 41/16

(52) U.S. Cl. ..... 315/248; 315/39; 315/344; 313/567; 313/572; 313/573; 313/642

(58) Field of Search ..... 315/248, 39, 344; 313/484, 552, 563, 564, 567, 572, 573, 637, 639, 643, 641, 642

(56) References Cited

U.S. PATENT DOCUMENTS

| | | | | | |
|---|---|---|---|---|---|
| 2,900,543 | A | | 8/1959 | Heuse | 313/60 |
| 3,234,421 | A | | 2/1966 | Reiling | 313/25 |
| 3,334,261 | A | | 8/1967 | Butler et al. | 313/229 |
| 4,485,332 | A | | 11/1984 | Ury et al. | 315/112 |
| 4,504,768 | A | | 3/1985 | Ury et al. | 315/248 |
| 4,507,587 | A | * | 3/1985 | Wood et al. | 315/39 |
| 4,695,757 | A | | 9/1987 | Ury et al. | 313/44 |
| 4,837,484 | A | | 6/1989 | Eliasson et al. | 313/634 |
| 4,887,008 | A | | 12/1989 | Wood | 315/39 |
| 4,945,290 | A | | 7/1990 | Eliasson et al. | 315/246 |
| 4,947,080 | A | | 8/1990 | Wood et al. | 315/248 |
| 4,954,756 | A | | 9/1990 | Wood et al. | 315/39 |
| 5,021,704 | A | | 6/1991 | Walker et al. | 313/35 |
| 5,032,757 | A | | 7/1991 | Witting | 313/44 |
| 5,438,235 | A | | 8/1995 | Sommerer et al. | 313/489 |
| 5,504,391 | A | | 4/1996 | Turner et al. | 313/570 |
| 5,594,303 | A | | 1/1997 | Simpson et al. | 315/39 |
| 5,686,793 | A | | 11/1997 | Turner et al. | 313/570 |
| 5,844,376 | A | | 12/1998 | Lapatovich | 315/248 |
| 5,866,980 | A | * | 2/1999 | Dolan et al. | 313/570 |
| 5,866,990 | A | | 2/1999 | Ury et al. | 315/248 |
| 5,903,091 | A | | 5/1999 | MacLennan et al. | 313/161 |
| 5,923,122 | A | | 7/1999 | Frank et al. | 313/607 |
| 5,952,784 | A | | 9/1999 | Witting | 313/634 |
| 5,959,405 | A | | 9/1999 | Soules et al. | 313/635 |
| 5,977,724 | A | | 11/1999 | Dolan et al. | 315/248 |
| 6,016,031 | A | | 1/2000 | Lapatovich et al. | 313/493 |
| 6,072,268 | A | * | 6/2000 | Dolan et al. | 313/112 |
| 6,084,348 | A | * | 7/2000 | Love | 313/567 |
| 6,157,141 | A | | 12/2000 | Lapatovich et al. | 315/248 |
| 6,181,054 | B1 | | 1/2001 | Levin et al. | 313/113 |

* cited by examiner

*Primary Examiner*—Don Wong
*Assistant Examiner*—Thuy Vinh Tran
(74) *Attorney, Agent, or Firm*—Antonelli, Terry, Stout & Kraus, LLP

(57) ABSTRACT

The present invention is a microwave excited electrodeless bulb and a process of generating ultraviolet light with a microwave excited electrodeless bulb. A process of generating ultraviolet light with a microwave excited electrodeless bulb in accordance with the invention includes providing an electrodeless bulb (19) with an envelope (32) containing an ultraviolet emissive material which emits ultraviolet light in response to microwave excitation. The envelope is filled with an ultraviolet emissive material. The envelope has a major internal dimension (30) between ⅓ and ½λ to which a strong field of the microwave excitation is coupled during emission of ultraviolet light with λ being the free space wavelength of the microwave excitation which varies between 2.4 and 2.5 GHz. The strong field is produced by a microwave source having a steady state rated output power of no greater than 0.85 kW. The bulb is rotated at a rotational velocity of at least 20 revolutions per minute. Ultraviolet emission occurs in selected ranges between 200 and 300 nm while a stream of air is directed in contact with the rotating bulb to provide cooling thereof.

47 Claims, 4 Drawing Sheets

MICROWAVE-POWERED ULTRAVIOLET ROTATING LAMP, AND PROCESS OF USE THEREOF

CROSS REFERENCE TO RELATED APPLICATION

Reference is made to the Assignee's U.S. patent application Ser. No. 09/771,671, filed on Jan. 30, 2001, which application is incorporated herein by reference in its entirety.

BACKGROUND OF THE INVENTION

1. Field of the Invention

The present invention is directed to an electrodeless microwave excited bulbs which emit ultraviolet light and processes for generating ultraviolet light with a microwave excited electrodeless bulbs.

2. Description of the Prior Art

The use of forced air to cool microwave excited electrodeless bulbs which are rotated is known. See U.S. Pat. Nos. 4,485,332; 4,695,757; 4,947,080; 4,954,756; 5,021,704; 5,594,303; 5,866,990 and 5,997,724. The systems disclosed herein are generally for applications of rotating small bulbs cooled with air flow having a major dimension of the bulb envelope of less than ¾ or for larger bulbs having a major internal dimension greater than ½ wherein λ is the free space wavelength of the microwaves used for excitation which is 2.45 GHz.

Small bulb products with a major internal dimension less the ¾ of the foregoing type are used in special applications, such as photo lithography, used in semiconductor processing. These systems require a small bulb as a consequence of the optics associated with the photo lithography and are heavy, large, and expensive as a consequence of higher power magnetrons used therein and complicated forced air cooling systems associated therewith. High speed rotation of the bulb in them is required to prevent harmful thermal gradients in the wall temperatures of the bulb envelope. Moreover, while substantial forced air cooling in combination with high speed rotation of the electrodeless bulb provides stable operation, the internal temperatures of the walls of the envelope are too high to permit the use of known additives to the envelope to modify the spectrum from that produced by the primary emissive materials such as Hg.

Mercury based electrodeless lamps have been in use for many years. See Electric Discharge Lamps by Dr. John Waymout, MIT Press, 1971.

Metal halides in combination with halogen doping of electrodeless lamps has been known since the 1960's. The use of Ba, Na, Ti, In and Cd iodides is disclosed in U.S. Pat. No. 3,234,431.

Lanthanides and rare earths are used as dopants in electrodeless bulbs to produce selected spectral emissions. U.S. Pat. No. 3,334,261 lists Y, La, Ce, Nd, Lu, Ho, Tn, Pr, Gd, Tb Dy and Er as dopants for electrodeless bulbs which produce visible light.

U.S. Pat. No. 3,947,714 discloses the use of $FeI_2$ as an additive to the constituents of an electrodeless bulb.

U.S. Pat. No. 6,157,141 discloses the use of Ga as a dopant in an electrodeless bulb.

U.S. Pat. Nos. 5,837,484 and 4,945,290 disclose eximer electrodeless bulbs using noble gases and gas mixtures.

U.S. Pat. Nos. 5,504,391 and 5,686,793 disclose eximer electrodeless lamps which operate at high pressure.

Moreover, Fusion Systems, Inc. of Gaithersburg, Md., has used forced air cooling of a rotating bulb in their AEL/HIIQ products which are powered by magnetrons having a power of at least 0.85 kW to produce wavelengths in the visible range with major internal dimensions of 30 mm respectively. The angular speed of the bulb in the AEL/HIIQ is variable between 250–300 revolutions per minute with air impingement cooling being used. The angular speed of the 35 mm, visible light bulb in the Solar 1000/Light Drive 1000 products of the same company (and reorganized Fusion Lighting, Inc.) is 3250 revolutions per minute with no driven air cooling being used.

SUMMARY OF THE INVENTION

The present invention is an electrodeless bulb and a process of generating ultraviolet light with a microwave excited electrodeless bulb which utilizes a bulb with an envelope having a major dimension between ⅓ and ½λ to which a strong field of microwave excitation varying between 2.4 and 2.5 GHz is applied with the strong field being produced by a microwave source having a steady state rated power no greater than 0.85 kW while being cooled with a forced air stream and rotated at a rotational velocity of at least 20 rpm and which contains an ultraviolet emissive material emitting ultraviolet light in response to the microwave excitation.

The aforementioned parameters of operation provide an electrodeless bulb and a process of lower cost than the prior art bulbs and processes using small bulbs with a major internal dimension of ¼λ or less. In a typical application of a rotating small electrodeless bulb used for photo lithography, the cost of the small bulb lamp may be between $15,000–$20,000, wherein the lamp of the present invention may cost $3,000–$5,000 which is useful for many applications not suited for small bulb lamp systems having major internal dimensions of the bulb less than ¼λ.

Larger lamp systems having major bulb internal dimensions greater than ½λ typically are excited by microwave power greater than a kilowatt and therefore, produce too much ultraviolet light output and are too large and heavy for the applications of the present invention.

The intermediate size bulbs of the present invention having a major dimension between ⅓ and ½λ are excited with microwave sources of less than 0.85 kW at an excitation frequency of 2.4 and 2.5 GHz which permits selective ultraviolet emission to be produced in accordance with known microwave emissive materials which are stable thermally and chemically within the envelope as a result of the wall temperatures of the envelope being stabilized as a consequence of rotation and forced air cooling so as to avoid hot spots causing thermal degrading of the microwave emissive materials and additives at the walls of the envelope and further undesirable thermal gradients in the walls of the bulb envelope and/or attacking of the walls of the bulb envelope by the plasma.

In one embodiment, the envelope within the foregoing major internal dimensional range is filled with between 10 mg and 100 mg of mercury as the emissive material and at a pressure of 20–600 Torr at room temperature and includes at least one buffer gas selected from at least one of the group consisting essentially of Ar, Kr and Xe with the ultraviolet emission being in a range between 200–300 nm while directing a stream of air in contact with the bulb to provide cooling thereof. The first embodiment may utilize $HgCl_2$ in an amount of not greater than 2 mg. in the envelope. The air stream may be laminar. The emission range between 200–300 nm may have a peak emission between 250–270 nm In another embodiment the envelope within the foregoing major internal dimensional range is filled with one of Xe or Ar gas as the emissive material at a pressure range from 10–2500 Torr at room temperature and chlorine gas in a pressure range from 0.5–200 Torr at room temperature which excites microwave emission between 200–310 nm while directing a stream of air in contact with the bulb to provide cooling thereof. The envelope may be filled with a metal halide dopant. The stream of air may be a laminar flow. The range between 200–310 nm may have a maximum peak range between 300–310 nm.

In an additional embodiment the envelope within the foregoing major internal dimensional range is filled with between 10–100 mg of Hg as the emissive material at a pressure of 200–600 Torr at room temperature and includes at least one of the group consisting essentially of Ar, Kr and Xe as a buffer gas with ultraviolet emission in a range of between 320–400 nm while directing a stream of air in contact with the bulb to provide cooling thereof. The envelope may contain up to 50 mg of halide selected from the group consisting essentially of Fe, Co, Ni, Pb and Al. Additionally, the envelope may also contain at least one other group of elements consisting essentially of Mn, Mg, Mo, Be, Cd, Ge and Li to provide additional emission in the spectrum of the ultraviolet light. The stream of air may be laminar flow. The range between 320–400 nm may have a peak between 350–380 nm.

In an another embodiment the envelope within the foregoing internal dimensional range is filled between 10–100 mg of Hg as the emissive material and at a pressure of 20–600 Torr at room temperature including at least one buffer gas selected from at least one of the group consisting essentially of Ar, Kr and Xe and at least one salt selected from the group consisting essentially of Ga, Al and Pb in an amount between 1 and 50 mg with the ultraviolet emission being in the range between 390–450 nm while directing a stream of air in contact with the bulb to provide cooling thereof. The stream of air may be laminar flow. The range between 390–450 nm may have a peak emission between 395–420 nm.

BRIEF DESCRIPTION OF THE DRAWINGS

Like parts are identified by like numbers throughout the description of the drawings.

DETAILED DESCRIPTION OF THE PREFERRED EMBODIMENTS

Figure 1:
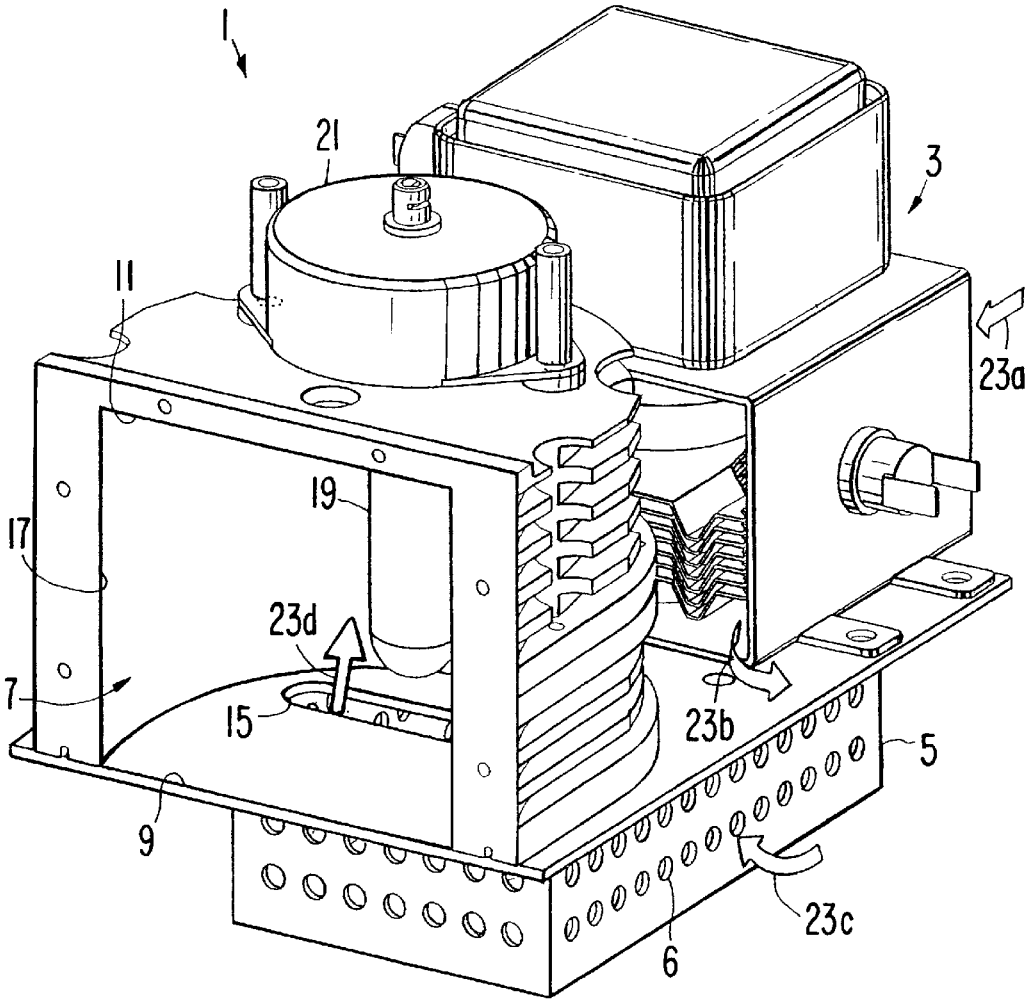
FIG. 1 illustrates an example of an ultraviolet lamp in which the bulb and process of the present invention may be used.
Figure 2:
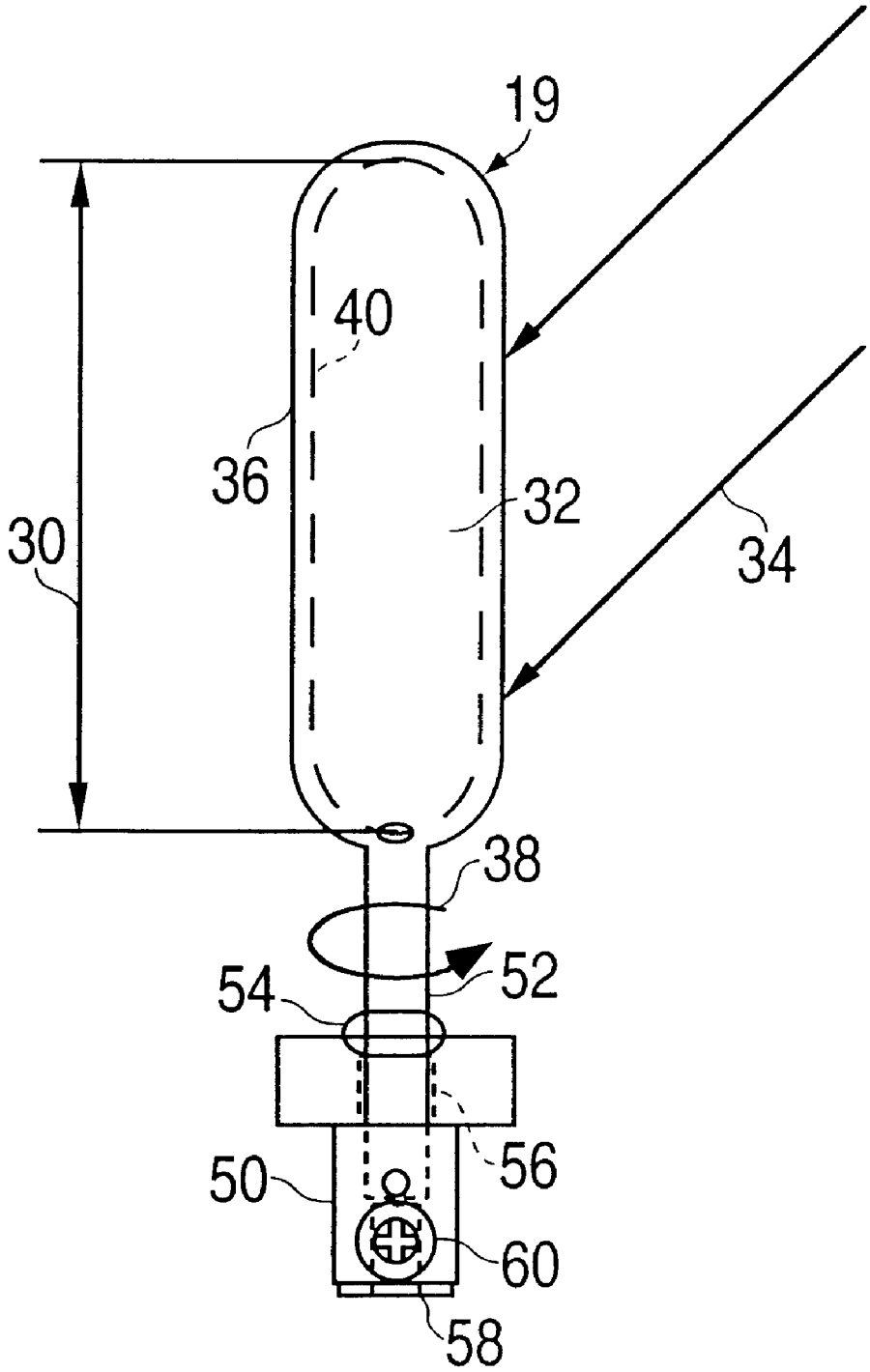
FIG. 2 illustrates a bulb in accordance with the present invention.

FIG. 1 illustrates a microwave-powered lamp 1 in which the bulb and process of the present invention may be practiced. FIG. 1 is contained in the above-referenced patent application. Lamp 1 includes magnetron 3 and microwave cavity 7 on the same side of waveguide 5. The magnetron 3 is selected to have a steady state output power of no greater than 0.85 kW with microwaves ranging in frequency between 2.4 and 2.5 MHz and centered at 2.45 MHz. The wall temperature of the bulb, as described below with reference to FIG. 2, is maintained at a controlled temperature permitting well-known filler gases and additives as discussed above and below to be used when a combination of rotation of the bulb 19, forced air cooling air 23*d*, the major dimension of the internal envelope being between ⅓ and ½λ with λ being the wavelength of the microwaves and magnetron 3 produces a maximum of 0.85 kW steady state power. The cooling air flow 23*d* maintained against the bulb 19 may be laminar while rotating the bulb at a speed of at least 20 rpm which permits different emission spectra to be obtained by selecting known emissive materials, filler gases, additives and dopants, which are not chemically and/or electrically unstable as a result of elimination of high wall temperatures as in lamps with bulbs with major internal dimensions of smaller size less than ¼λ and higher input power.

The cavity 7 is defined by end members 9 and 11 and reflective member 17. Reflective member 17 extends between end members 9 and 11 and provides a curved surface to direct the ultraviolet light toward a target. Desirably, member 17 has a shape of a partial ellipse, cut off to form the opening of cavity 7 which emits light. The member 17 is made as a single member forming the cavity 7, but can be made of a plurality of parts connected together to form cavity 7.

As shown in FIG. 1, RF slot 15 introduces microwaves from waveguide 5 into cavity 7 so that a strong microwave field is coupled to a major dimension of the bulb 19, e.g. the longitudinal dimension. Bulb 19 is aligned with slot 15. The central axis of bulb 19 intersects a central line extending in the lengthwise direction of slot 15.

Bulb rotation motor 21 rotates the bulb 19 at speeds during ultraviolet emission of at least 20 revolutions per minute. However, much higher rotational speeds of the bulb are not required since the selected speed needs only to be sufficient in combination with the forced air cooling to provide stable wall temperatures of the bulb without large thermal gradients over the interior dimension of the bulb.

Forced air flow occurs through lamp 1. The airflow 23*d* past the bulb 19 provides cooling which, in combination with the size and rotation of the bulb and the steady state rated maximum output power of the magnetron being no greater than 0.85 kW, produces stable operation using known emissive materials and additives in the bulb 19 which are not stable in association with higher wall temperatures. Although not shown in FIG. 1, lamp 1 is within a housing so as to channel the air flow. Air flow 23*a* past the magnetron 3 provides cooling thereof then passes from the magnetron 3 as air flow 23*b*. Air flow 23*c* then passes into waveguide 5 through holes 6 therein. The air flow 23*d* then passes through RF slot 15 to cool rotating bulb 19 in cavity 7. The air flow 23*a–d* is used to cool both the bulb 19 and magnetron 3.

The source of the airflow 23*a*–23*d* maybe from any known source, such as, but not limited to, a fan (not illustrated) of any known design. The flow 23*d* may be laminar but is not limited thereto and could be turbulent if bulb cooling requirements are significant.

Moreover, it should be understood that the practice of the present invention is not limited to the system of FIG. 1. For example, the invention may be practiced in other microwave power lighting systems, such as illustrated in the above-referenced patents, which produce ultraviolet light using bulb rotation in combination with cooling air directed into contact with the rotating bulb.

FIG. 2 illustrates a bulb 19 which may be used with the practice of the present invention. The bulb has a major dimension 30 which is between ⅓ and ½λ with λ being the wavelength of the microwaves produced by magnetron 3 at a frequency centered nominally at 2.45 GHz. At 2.45 GHz the free space wavelength λ is equal to approximately 120 mm. Bulbs having a major dimension between ⅓ and ½λ are considered to be intermediate sized bulbs which provide selectable output spectras across the ultraviolet spectrum produced by the addition of known filler gases, dopants and additives which may be selected in accordance with the addition of emissive materials and additives which are thermally and electrically stable relative to the wall temperatures of the envelope 32 as a consequence of cooling air 34 impinging on the outer surface 36 in either a laminar or turbulent fashion and further, rotation 38 caused by motor 21 at speeds of at least 20 revolutions per minute to control the temperature of wall 40 to be lower than with the prior art bulbs having a major dimension of less than ¼λ. The limiting of the output power of the magnetron 3 to no more than 0.85 kW in combination with the major dimension 30 between ⅓ and ½λ, which may be measured in a longitudinal, axial or diametrical directions of the bulb envelope, cooling air 34, rotation 38 and the selective choice of ultraviolet emissive materials, filler gas at selected pressures and additional additives and/or dopants as described below provides a new ultraviolet bulb. As a result of the foregoing operational parameters, the interior walls 40 of the bulb 19 are thermally and electrically stable and are not degraded or eroded by the plasma within the envelope 32 during emission. Furthermore, the limiting of the microwave power coupled to the emissive materials within the envelope 32 limits the temperature therein so that the choice of emissive materials and additives is not subject to chemical and electrical instabilities caused by high wall bulb temperatures which characterize small UV lamps (less than ¼λ) which, while rotated and cooled, produce higher output powers making it difficult to maintain stability of the bulb in combination with the ability to selectively choose a stable emission characteristic over the life of the bulb as a result of the known selectable materials which affect the emission spectra not being chemically or electrically unstable when subjected to high envelope wall temperatures.

While bulb 19 is illustrated as being elongated along the major dimension 30, it should be understood that the present invention is not limited to elongated tubular cylindrical bulbs with spherical, prolate or oblate shapes being also within the scope of the invention having a major dimension 30 between ⅓ and ½λ.

A collar 50 of aluminum or other metal is attached to the stem 52 by a suitable adhesive, such as epoxy 54, which is stable in a microwave environment. The collar 50 has a cylindrical bore 56 in which the stem 52 fits and is held by the aforementioned adhesive 54. The bottom of the collar has a cylindrical recess 58 which receives the shaft of the motor 21 and is held in place by a set screw 60 or any other conventional attachment mechanism.

A first process of generating ultraviolet light with a microwave excited electrodeless bulb in accordance with the invention utilizing the bulb 19 of FIG. 2 is as follows. An electrodeless bulb 19 with an envelope 32 containing an ultraviolet emissive material is used which emits ultraviolet light in response to microwave excitation. The envelope 32 is filled between 10–100 mg of Hg as the emissive material at a pressure of 20–600 Torr at room temperature including at least one buffer gas selected from at least one of the group consisting essentially of Ar, Kr and Xe. Furthermore, at least one salt is contained in the envelope 32 selected from the group consisting essentially of Ga, Al and Pb halides in an amount of 1–50 mg which provides strong emitters of radiation at the wavelengths different from those radiated by the Hg atoms. As illustrated in FIG. 2, the envelope has a major internal dimension 30 between ¼ and ½λ with a strong field of the microwave excitation being coupled to the major dimension during emission of the ultraviolet light with λ being the wavelength of the microwave excitation which varies between 2.4 and 2.5 GHz with the strong being produced by the microwave source having a steady state rated output power of no greater than 0.85 kW. The rotational velocity of the bulb is at least 20 revolutions per minute with the microwave excitation exciting microwave emission in a range between 390–450 nm. The air stream may be turbulent but a laminar flow has been found to be sufficient to provide necessary cooling. The range between 390–450 nm has a maximum peak between 395–420 nm.

A second process of generating ultraviolet light with a microwave excited electrodeless bulb is as described above except that the at least one salt selected from the group consisting essentially of Ba, Al and Pb halides in an amount of between 1 and 50 mg is not utilized and the wavelength of the ultraviolet emissive material is between 200–300 nm. Additionally, the envelope may contain $HgCl_2$ in an amount not greater than 2 mg which performs the function of additional stabilization of the discharge. The range between 200–300 nm has a broad peak between 250–270 nm as illustrated in FIG. 3.

A third process of generating ultraviolet light with a microwave excited bulb fills the envelope 32 with one of Xe or Kr gas as the emissive material in a pressure range from 10–2500 Torr at room temperature and $Cl_2$ gas in a pressure range from 0.5–200 Torr at room temperature. The excitation varies between 2.4 and 2.5 GHz from a microwave source having a steady state rated output power of no greater than 0.85 kW and the bulb is rotated at a velocity of at least 20 rpm. The ultraviolet emission is between 200–310 nm with a stream of air being directed in contact with the bulb to provide cooling thereof. The envelope may be filled with a halide dopant which may be any of cd, Sr, si and Pt to provide additional spectral lines. The stream of air may be turbulent but laminar flow has been found to be sufficient. The simplest bulb fill for this range contains Xe and $Cl_2$ only and has a dominant excimer peak 308 nm as illustrated in FIG. 4.

A fourth process of generating ultraviolet light with a microwave excited electrodeless bulb is in accordance with a second process described above except that the ultraviolet emission is in a range between 320–400 nm. The envelope 32 contains up to 50 mg of halide selected from the group consisting essentially of Fe, Co, Ni, Pb and Al which perform the function of providing strong emitters of radiation at the wavelengths different from those radiated by the Hg atoms. The envelope also contains at least one of the group of elements consisting essentially of Nm, Mg, Mo, Be, Cd, Ge and Li which modify the spectrum of ultraviolet light by providing additional spectral lines. The stream of air, which may be turbulent, has been found to be sufficient when laminar flow is utilized for providing cooling of the bulb. The range between 320–400 nm has a maximum peak between 350–380 nm.

Figure 3:
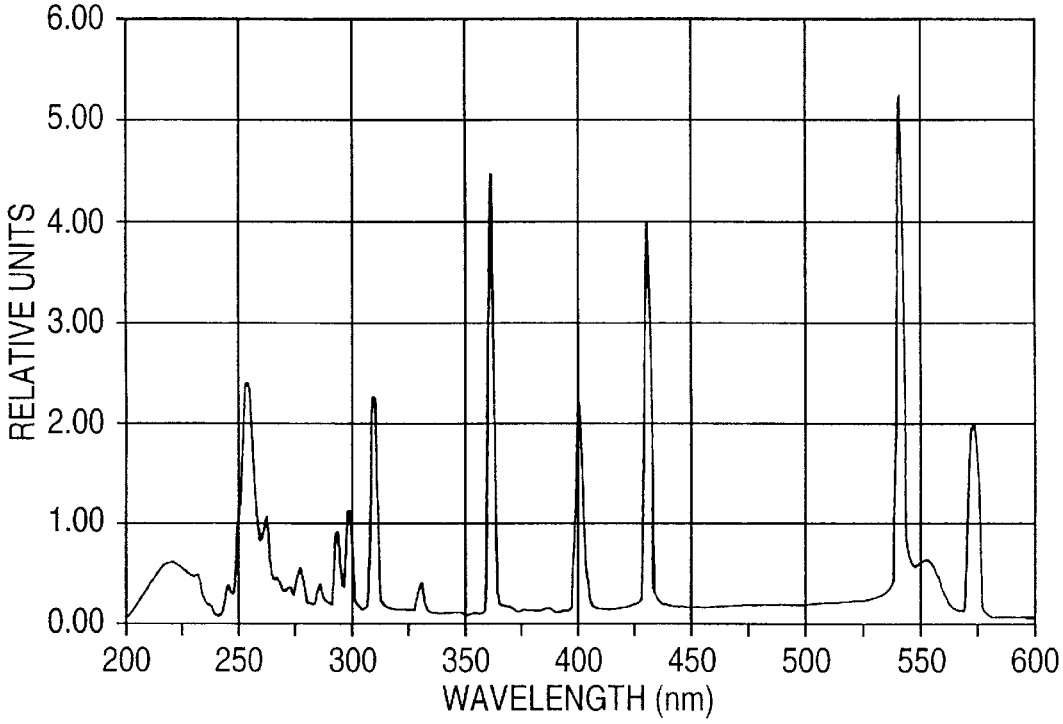
FIGS. 3–6 illustrate examples of emission spectra which are produced by the bulb and process of the present invention.

FIG. 3 illustrates a first emission spectrum which may be obtained with the process of generating ultraviolet light with a microwave excited electrodeless bulb with internal envelope dimensions of 52 mm in length and a 15 mm inner diameter in accordance with the present invention. The constituents of the envelope are 25 mg of Hg, 50 Torr of Ar and 0.14 mg of $HgCl_2$.

Figure 4:
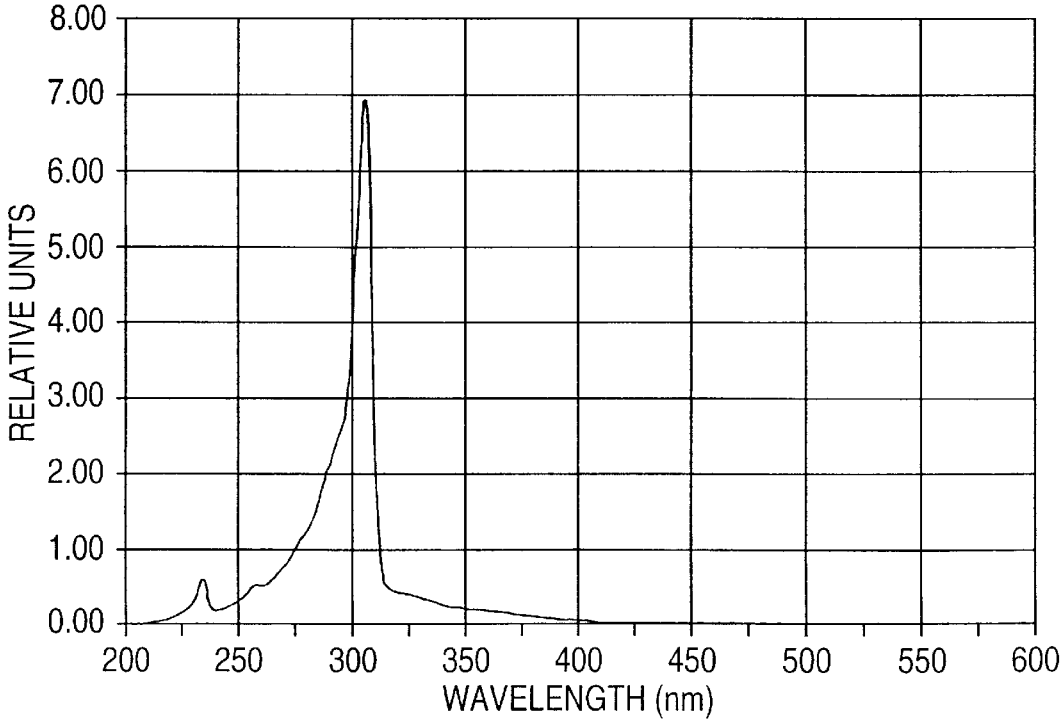

FIG. 4 illustrates a second emission spectrum which may be obtained with the process of generating ultraviolet light with a microwave excited electrodeless bulb with internal envelope dimensions of 52 mm in length and a 15 mm diameter in accordance with the present invention. The constituents are 1530 Torr of Xe and 68 Torr of $Cl_2$.

Figure 5:
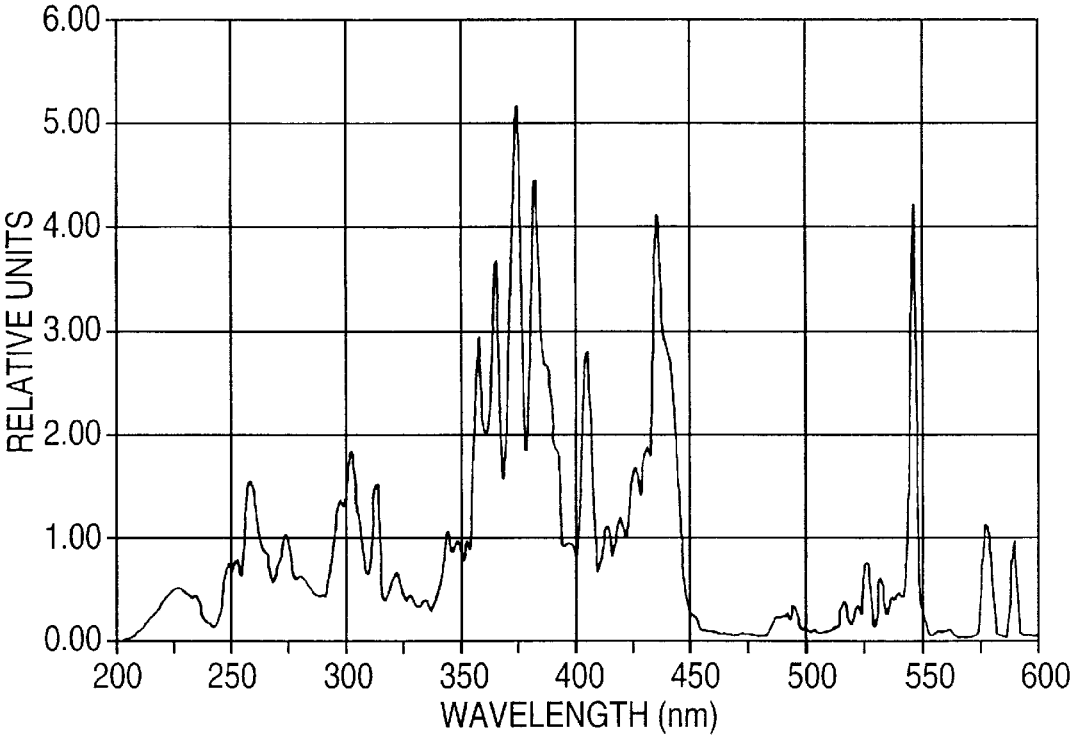

FIG. 5 illustrates a third emission spectrum which may be obtained with the process of generating ultraviolet light with a microwave excited electrodeless bulb with internal envelope dimensions of 52 mm in length and a 13 mm inner diameter in accordance with the present invention. The constituents are 35 mg of Hg, 60 Torr of Ar and 1 mg of $FeI_3$.

Figure 6:
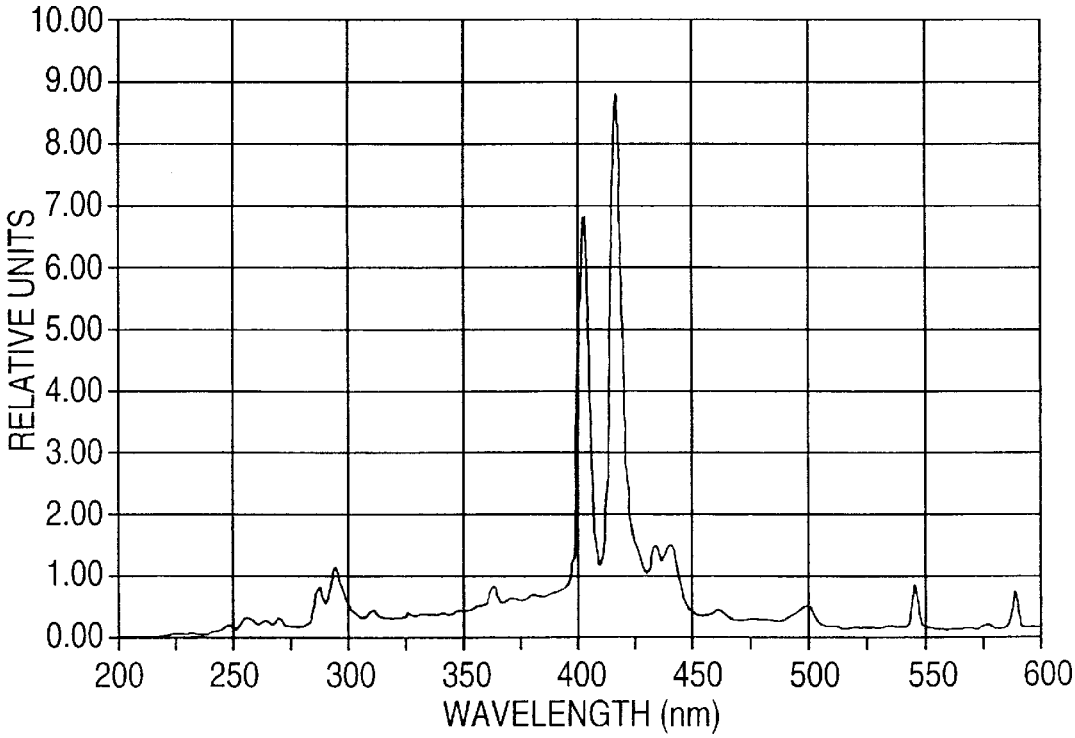

FIG. 6 illustrates a fourth emission spectrum which may be obtained with the process of generating ultraviolet light with a microwave excited electrodeless bulb with internal envelope dimensions of 52 mm in length and a 15 mm inner diameter in accordance with the present invention. The constituents are 40 mg of Hg, 60 Torr of Ar, and 1.3 mg of $GaI_3$.

While the present invention has been described in terms of its preferred embodiments, it should be understood that numerous modifications may be made thereto without departing from the spirit and scope of the present invention. It is intended that all such modifications fall within the scope of the appended claims.

What is claimed is:

1. A process of generating ultraviolet light with a microwave excited electrodeless bulb comprising:

providing an electrodeless bulb with an envelope containing an ultraviolet emissive material which emits ultraviolet light in response to microwave excitation, the envelope being filled with between 10 mg and 100 mg of Hg as the emissive material and at a pressure of 20–600 Torr at room temperature and includes at least one buffer gas selected from at least one of the group consisting essentially of Ar, Kr and Xe, the envelope having a major internal dimension between ⅓ and ½λ to which a strong field of the microwave excitation is coupled during emission of ultraviolet light with λ being the wavelength of the microwave excitation which varies between 2.4 and 2.5 GHz and the strong field being produced by a microwave source having a steady state rated output power of no greater than 0.85 kW; and coupling microwave excitation from the microwave source to the ultraviolet emissive material while rotating the bulb at a rotational velocity of at least 20 revolutions per minute which excites ultraviolet emission in a range between 200 and 300 nm while directing a stream of air in contact with the bulb to provide cooling thereof.

2. A process in accordance with claim 1 wherein:

the envelope contains $HgCl_2$ in an amount not greater than 2 mg.

3. A process in accordance with claim 2 wherein:

the stream of air is a laminar flow.

4. A process in accordance with claim 3 wherein:

the range between 200 and 300 nm has a maximum peak between 250 and 270 nm.

5. A process in accordance with claim 2 wherein:

the range between 200 and 300 nm has a maximum peak between 250 and 270 nm.

6. A process in accordance with claim 1 wherein:

the stream of air is a laminar flow.

7. A process in accordance with claim 6 wherein:

the range between 200 and 300 nm has a maximum peak between 250 and 270 nm.

8. A process in accordance with claim 1 wherein:

the range between 200 and 300 nm has a maximum peak between 250 and 270 nm.

9. A process of generating ultraviolet light with a microwave excited bulb comprising:

providing an electrodeless bulb with an envelope containing an ultraviolet emissive material which emits ultraviolet light in response to microwave excitation, the envelope being filled with one of Xe or Kr gas as the emissive material in a pressure range from 10–2500 Torr at room temperature and chlorine gas in a pressure range from 0.5–200 Torr at room temperature, the envelope having a major internal dimension between ⅓ and ½λ to which a strong field of the microwave excitation is coupled during emission of ultraviolet light with λ being the wavelength of the microwave excitation which varies between 2.4 an 2.5 GHz and the strong field produced by a microwave source having a steady state rated output power of no greater than 0.85 kW; and coupling the microwave excitation from the microwave source to the ultraviolet emissive material while rotating the bulb at a rotatable velocity of at least 20 revolutions per minute which excites ultraviolet emission between 200–310 nm while directing a stream of air in contact with the bulb to provide cooling thereof.

10. A process in accordance with claim 9 wherein:

the envelope is filled with a metal halide dopant.

11. A process in accordance with claim 10 wherein:

the range between 200 and 310 nm has a maximum peak between 300 and 310 nm.

12. A process in accordance with claim 10 wherein:

the stream of air is a laminar flow.

13. A process in accordance with claim 9 wherein:

the stream of air is a laminar flow.

14. A process in accordance with claim 13 wherein:

the range between 200 and 310 nm has a maximum peak between 300 and 310 nm.

15. A process in accordance with claim 9 wherein:

the range between 200 and 300 nm has a maximum peak between 300 and 310 nm.

16. A process of generating ultraviolet light with a microwave excited electrodeless bulb comprising:

providing an electrodeless bulb with an envelope containing an ultraviolet emissive material which emits ultraviolet light in response to microwave excitation, the envelope being filed with between 10 mg and 100 mg of Hg as the emissive material and at a pressure of 20–600 Torr at room temperature and including at least one of the group consisting essentially of Ar, Kr and Xe as a buffer gas, the envelope having a major internal dimension between ⅓ and ½λ to which a strong field of the microwave excitation is coupled during emission of ultraviolet light with A being the wavelength of the microwave excitation which varies between 2.4 and 2.5 GHz and the strong field being produced by a microwave source having a steady state rated output power of no greater than 0.85 kW; and coupling the microwave excitation from the microwave source to the envelope while rotating the bulb at a rotational velocity of at least 20 revolutions per minute, which excites ultraviolet emission in a range between 320 and 400 nm while directing a stream of air in contact with the bulb to provide cooling thereof.

17. A process in accordance with claim 16 wherein:

the envelope contains up to 50 mg of halides selected from the group consisting essentially of Fe, Co, Ni, Pb and Al.

18. A process in accordance with claim 17 wherein:

the envelope also contains at least one of the group of elements consisting essentially of Mn, Mg, Mo, Be, Cd, Ge and Li which modify the spectrum of the ultraviolet light.

19. A process in accordance with claim 18 wherein:

the stream of air is a laminar flow.

20. A process in accordance with claim 18 wherein:

the range between 320 and 400 nm has a maximum peak between 350 and 380 nm.

21. A process in accordance with claim 17 wherein:

the stream of air is a laminar flow.

22. A process in accordance with claim 21 wherein:

the range between 320 and 400 nm has a maximum peak between 350 and 380 nm.

23. A process in accordance with claim 17 wherein:

the range between 320 and 400 nm has a maximum peak between 350 and 380 nm.

24. A process in accordance with claim 16 wherein:

the stream of air is a laminar flow.

25. A process in accordance with claim 24 wherein:

the range between 320 and 400 nm has a maximum peak between 350 and 380 nm.

26. A process in accordance with claim 16 wherein:

the range between 320 and 400 nm has a maximum peak between 350 and 380 nm.

27. A process of generating ultraviolet light with a microwave excited electrodeless bulb comprising:

providing an electrodeless bulb with an envelope containing an ultraviolet emissive material which emits ultraviolet light in response to microwave excitation, the envelope being filled with between 10 mg and 100 mg of Hg as the emissive material and at a pressure of 20–600 Torr at room temperature, including at least one buffer gas selected from at least one of the group consisting essentially of Ar, Kr and Xe, and at least one salt selected from the group consisting essentially of Ga, Al and Pb in an amount of 1 to 50 mg, the envelope having a major internal dimension between ⅓ and ½λ to which a strong field of the microwave excitation is coupled during emission of ultraviolet light with λ being the wavelength of the microwave excitation which varies between 2.4 and 2.5 GHz and the strong field being produced by a microwave source having a steady state rated output power of no greater than 0.85 kW; and coupling microwave excitation from the microwave source to the envelope while rotating the bulb at a rotational velocity of at least 20 revolutions per minute which excites ultraviolet emission in a range between 390 and 450 nm while directing a stream of air in contact with the bulb to provide cooling thereof.

28. A process in accordance with claim 27 wherein:

the stream of air is a laminar flow.

29. A process in accordance with claim 28 wherein:

the range between 390 and 450 nm has a maximum peak between 395 and 420 nm.

30. A process in accordance with claim 27 wherein:

the range between 390 and 450 nm has a maximum peak between 395 and 420 nm.

31. In a system which generates ultraviolet light with microwave excitation of a bulb from a microwave source having a steady state rated output power of no greater than 0.85 kW with λ being a wavelength of the microwave excitation which varies between 2.4 and 2.5 GHz while rotating the bulb at a rotational velocity of at least 20 revolutions per minute while directing a stream of air in contact with the bulb to provide cooling thereof, the bulb comprising:

an envelope containing an ultraviolet emissive material which emits ultraviolet light in response to microwave excitation, the envelope being filled with an emissive material and includes at least one buffer gas, the envelope having a major internal dimension between ⅓ and ½λ to which a strong field of the microwave excitation is coupled during emission of ultraviolet light.

32. A bulb in accordance with claim 31 wherein:

the envelope is filled with between 10 mg and 100 mg of Hg as the emissive material and at a pressure of 20–600 Torr at room temperature and includes at least one buffer gas selected from at least one of the group consisting essentially of Ar, Kr and Xe, and the ultraviolet emission is in a range between 200 and 300 nm.

33. A bulb in accordance with claim 32 wherein:

the envelope contains $HgCl_2$ in an amount not greater than 2 mg.

34. A bulb in accordance with claim 33 wherein:

the range between 200 and 300 nm has a maximum peak between 250 and 270 nm.

35. A bulb in accordance with claim 32 wherein:

the range between 200 and 300 nm has a maximum peak between 250 and 270 nm.

36. A bulb in accordance with claim 31 wherein:

the envelope is filled with one of Xe or Kr gas as the emissive material in a pressure range from 10–2500 Torr at room temperature and chlorine gas in a pressure range from 0.5–200 Torr at room temperature ultraviolet emission is between 200–310 nm.

37. A bulb in accordance with claim 36 wherein:

the envelope is filled with a metal halide dopant.

38. A bulb in accordance with claim 37 wherein:

the range between 200 and 310 nm has a maximum peak between 300 and 310 nm.

39. A bulb in accordance with claim 36 wherein:

the range between 200 and 300 nm has a maximum peak between 300 and 310 nm.

40. A bulb in accordance with claim 31 wherein:

the envelope is filed with between 10 mg and 100 mg of Hg as the emissive material and at a pressure of 20–600 Torr at room temperature and including at least one of the group consisting essentially of Ar, Kr and Xe as a buffer gas and the ultraviolet emission is in a range between 320 and 400 nm.

41. A bulb in accordance with claim 40 wherein:

the envelope contains up to 50 mg of halides selected from the group consisting essentially of Fe, Co, Ni, Pb and Al.

42. A bulb in accordance with claim 41 wherein:

the envelope also contains at least one of the group of elements consisting essentially of Mn, Mg, Mo, Be, Cd, Ge and Li which modify the spectrum of the ultraviolet light.

43. A bulb in accordance with claim 42 wherein:

the range between 320 and 400 nm has a maximum peak between 350 and 380 nm.

44. A bulb in accordance with claim 40 wherein:

the range between 320 and 400 nm has a maximum peak between 350 and 380 nm.

45. A bulb in accordance with claim 41 wherein:

the range between 320 and 400 nm has a maximum peak between 350 and 380 nm.

46. A bulb in accordance with claim 31 wherein:

the envelope is filled with between 10 mg and 100 mg of Hg as the emissive material and at a pressure of 20–600 Torr at room temperature, including at least one buffer gas selected from at least one of the group consisting essentially of Ar, Kr and Xe, and at least one salt selected from the group consisting essentially of Ga, Al and Pb in an amount of 1 to 50 mg and the ultraviolet emission is in a range between 390 and 450 nm.

47. A bulb in accordance with claim 46 wherein:

the range between 390 and 450 nm has a maximum peak between 395 and 420 nm.

* * * * *

UNITED STATES PATENT AND TRADEMARK OFFICE

CERTIFICATE OF CORRECTION

PATENT NO. : 6,559,607 B1
DATED : May 6, 2003
INVENTOR(S) : Robert Ervin et al.

It is certified that error appears in the above-identified patent and that said Letters Patent is hereby corrected as shown below:

Title page,
Item [75], Inventor, please correct the third inventor's name to read
-- Miodrag Cekic --.

Signed and Sealed this

Fifteenth Day of July, 2003

JAMES E. ROGAN
*Director of the United States Patent and Trademark Office*